US010586484B2

(12) United States Patent
Liu et al.

(10) Patent No.: US 10,586,484 B2
(45) Date of Patent: Mar. 10, 2020

(54) SELECTION AND OUTPUT CIRCUIT, AND DISPLAY DEVICE

(71) Applicant: BOE Technology Group Co., Ltd., Beijing (CN)

(72) Inventors: Jianfu Liu, Beijing (CN); Shihao Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/023,921

(22) Filed: Jun. 29, 2018

(65) Prior Publication Data

US 2019/0066570 A1 Feb. 28, 2019

(30) Foreign Application Priority Data

Aug. 22, 2017 (CN) ..... 2017 1 0726030

(51) Int. Cl.
*G09G 3/36* (2006.01)
*G09G 3/30* (2006.01)
*G09G 3/20* (2006.01)

(52) U.S. Cl.
CPC ..... *G09G 3/2092* (2013.01); *G09G 3/20* (2013.01); *G09G 3/3696* (2013.01); *G09G 2310/0267* (2013.01); *G09G 2310/0286* (2013.01); *G09G 2310/0291* (2013.01); *G09G 2330/04* (2013.01)

(58) Field of Classification Search
CPC ..... G09G 3/3696; G09G 2310/0248; G09G 2330/02; G09G 2330/021; G09G 2330/026; G09G 2330/028
See application file for complete search history.

(56) References Cited

U.S. PATENT DOCUMENTS

2001/0030645 A1* 10/2001 Tsutsui ..... G09G 3/3611 345/211
2001/0055216 A1* 12/2001 Shirato ..... H02M 7/217 363/21.07
2003/0122812 A1* 7/2003 Onozawa ..... G09G 3/296 345/211
2003/0141823 A1* 7/2003 Sano ..... G09G 3/296 315/169.3
2005/0052890 A1* 3/2005 Morita ..... G09G 3/3688 365/87
2005/0140596 A1* 6/2005 Lee ..... G09G 3/3233 345/76
2005/0194932 A1* 9/2005 Kokubu ..... H04W 52/0277 320/116
2005/0194953 A1* 9/2005 Chang ..... G05F 1/56 323/313

(Continued)

*Primary Examiner* — Michael J Eurice
(74) *Attorney, Agent, or Firm* — Arent Fox LLP; Michael Fainberg

(57) ABSTRACT

The present disclosure discloses a selection and output circuit, and a display device, and the selection and output circuit includes: a first control sub-circuit, a second control sub-circuit, a first output sub-circuit, and a second output sub-circuit, where the first control sub-circuit, the second control sub-circuit, the first output sub-circuit, and the second output sub-circuit are arranged so that the first output sub-circuit and the second output sub-circuit are controlled by the first control sub-circuit and the second control sub-circuit to operate in such a way that only one of the sub-circuits outputs a signal, and the other sub-circuit outputs no signal.

2 Claims, 4 Drawing Sheets

(56) References Cited

U.S. PATENT DOCUMENTS

2005/0231501 A1* 10/2005 Nitawaki ..... G09G 3/36 345/211
2006/0066552 A1* 3/2006 Morita ..... G09G 3/3655 345/94
2007/0262438 A1* 11/2007 Choa-Eoan ..... H03K 17/223 257/691
2008/0048755 A1* 2/2008 Cho ..... H03K 17/22 327/333
2008/0074413 A1* 3/2008 Ogura ..... G09G 3/3233 345/212
2008/0074818 A1* 3/2008 Lee ..... H02H 7/1213 361/91.3
2008/0111774 A1* 5/2008 Iida ..... G09G 3/3233 345/76
2008/0165173 A1* 7/2008 Choi ..... G09G 3/3208 345/211
2008/0238953 A1* 10/2008 Ogura ..... G09G 3/3275 345/697
2009/0009952 A1* 1/2009 Lv ..... H03K 17/9517 361/679.27
2009/0096484 A1* 4/2009 Jao ..... H03K 3/356113 326/68
2009/0109142 A1* 4/2009 Takahara ..... G09G 3/006 345/76
2009/0122048 A1* 5/2009 Moriyama ..... G09G 3/296 345/212
2010/0085472 A1* 4/2010 Chen ..... H04N 5/232 348/372
2010/0109441 A1* 5/2010 Gagne ..... H03K 19/0016 307/80
2010/0177081 A1* 7/2010 Lee ..... G09G 3/20 345/211
2010/0289831 A1* 11/2010 Yamamoto ..... G09G 3/3233 345/690
2011/0084958 A1* 4/2011 Choi ..... G09G 3/3233 345/213
2011/0128277 A1* 6/2011 Murakami ..... H03F 3/3022 345/212
2012/0280959 A1* 11/2012 Shiu ..... G09G 3/20 345/211
2012/0286752 A1* 11/2012 Tsukiji ..... H02M 3/156 323/282
2013/0321494 A1* 12/2013 Takaki ..... G09G 3/2018 345/691
2014/0068292 A1* 3/2014 Ke ..... G06F 1/30 713/320
2016/0063941 A1* 3/2016 Xu ..... G09G 3/3614 345/212
2016/0079785 A1* 3/2016 Kinzer ..... H02J 7/0052 320/107
2016/0079975 A1* 3/2016 Kinzer ..... H03K 17/687 327/109
2018/0226817 A1* 8/2018 Heiling ..... H02J 7/0034

* cited by examiner

SELECTION AND OUTPUT CIRCUIT, AND DISPLAY DEVICE

CROSS-REFERENCE TO RELATED APPLICATION

This application claims priority of Chinese Patent Application No. 201710726030.4, filed on Aug. 22, 2017, which is hereby incorporated by reference in its entirety.

FIELD

The present disclosure relates to the field of a control circuit in a display panel, and particularly to a selection and output circuit, and a display device.

BACKGROUND

At present, a display panel has been widely applied in the field of flat panel display devices including a mobile phone, a PDA, a digital camera, etc., and particularly one of two different voltage is selected and output in various scenarios during human-machine interaction through the display device above, so the selection and output circuit switches the voltage to be output, in the different application scenarios so that a corresponding function is performed.

SUMMARY

An embodiment of the present disclosure provides a selection and output circuit including: a first control sub-circuit, a second control sub-circuit, a first output sub-circuit, a second output sub-circuit, a first input terminal, a second input terminal, a reference signal terminal, a control terminal, and an output terminal, wherein:

the first control sub-circuit is configured to provide a first node with a first control signal or a second control signal under the control of the control terminal;

the second control sub-circuit is configured to provide the second output sub-circuit with a signal of the second input terminal when the signal of the first node is the first control signal, and to provide the second output sub-circuit with a signal of the reference signal terminal when the signal of the first node is the second control signal;

the first output sub-circuit is configured to provide the output terminal with a signal of the first input terminal when the signal of the first node is the first control signal; and the second output sub-circuit is configured to provide the output terminal with the signal of the second input terminal when the second control sub-circuit provides the second output sub-circuit with the signal of the reference signal terminal.

In some implementations, in the selection and output circuit above according to the embodiment of the present disclosure, the first control sub-circuit includes a first switch transistor and a first resistor, wherein:

the first switch transistor has a gate connected with the control terminal, a first electrode connected with the reference signal terminal, and a second electrode connected with the first node; and the first resistor has one terminal connected with the first node, and the other terminal connected with the second input terminal.

In some implementations, in the selection and output circuit above according to the embodiment of the present disclosure, the second control sub-circuit includes a NOT gate, wherein:

the NOT gate has an input terminal connected with the first node, a first power supply terminal connected with the reference signal terminal, a second power supply terminal connected with the second input terminal, and an output terminal connected with the second output terminal.

In some implementations, in the selection and output circuit above according to the embodiment of the present disclosure, the first output terminal includes a second switch transistor, wherein the second switch transistor has a gate connected with the first node, a first electrode connected with the first input terminal, and a second electrode connected with the output terminal.

In some implementations, in the selection and output circuit above according to the embodiment of the present disclosure, the second output sub-circuit includes a third switch transistor, wherein:

the third switch transistor has a gate connected with the second control sub-circuit, a first electrode connected with the second input terminal, and a second electrode connected with the output terminal.

In some implementations, in the selection and output circuit above according to the embodiment of the present disclosure, the selection and output circuit further includes a first protection sub-circuit, wherein:

the first protection sub-circuit is configured to provide the output terminal with the signal output by the first output sub-circuit.

In some implementations, in the selection and output circuit above according to the embodiment of the present disclosure, the first protection sub-circuit includes a first diode, wherein:

the first diode has an input terminal connected with the first output sub-circuit, and an output terminal connected with the output terminal.

In some implementations, in the selection and output circuit above according to the embodiment of the present disclosure, the selection and output circuit further includes a second protection sub-circuit, wherein:

the second protection sub-circuit is configured to provide the output terminal with the signal output by the second output sub-circuit.

In some implementations, in the selection and output circuit above according to the embodiment of the present disclosure, the second protection sub-circuit includes a second diode, wherein:

the second diode has an input terminal connected with the second output sub-circuit, and an output terminal connected with the output terminal.

Correspondingly an embodiment of the present disclosure further provides a display device including the selection and output circuit according to any one of the embodiments above.

DETAILED DESCRIPTION OF THE EMBODIMENTS

In the related art, the selection circuit for controlling one of two different voltage to be output is generally a single-pole double-throw relay, but as known by the inventor, the volume of the existing smallest single-pole double-throw relay is 1.55 mm*10.5 mm*11.8 mm, and apparently the volume of even the smallest single-pole double-throw relay is so large; and since both the volume and the weight thereof are large, it is not suitable for a device for which high reliability is required, and a space to be occupied is required to be small, and there is such a high operating cost of the relay that discourages a production cost from being lowered.

Implementations of a selection and output circuit, and a display device according to the embodiments of the present disclosure will be described below in details with reference to the drawings.

Figure 1:
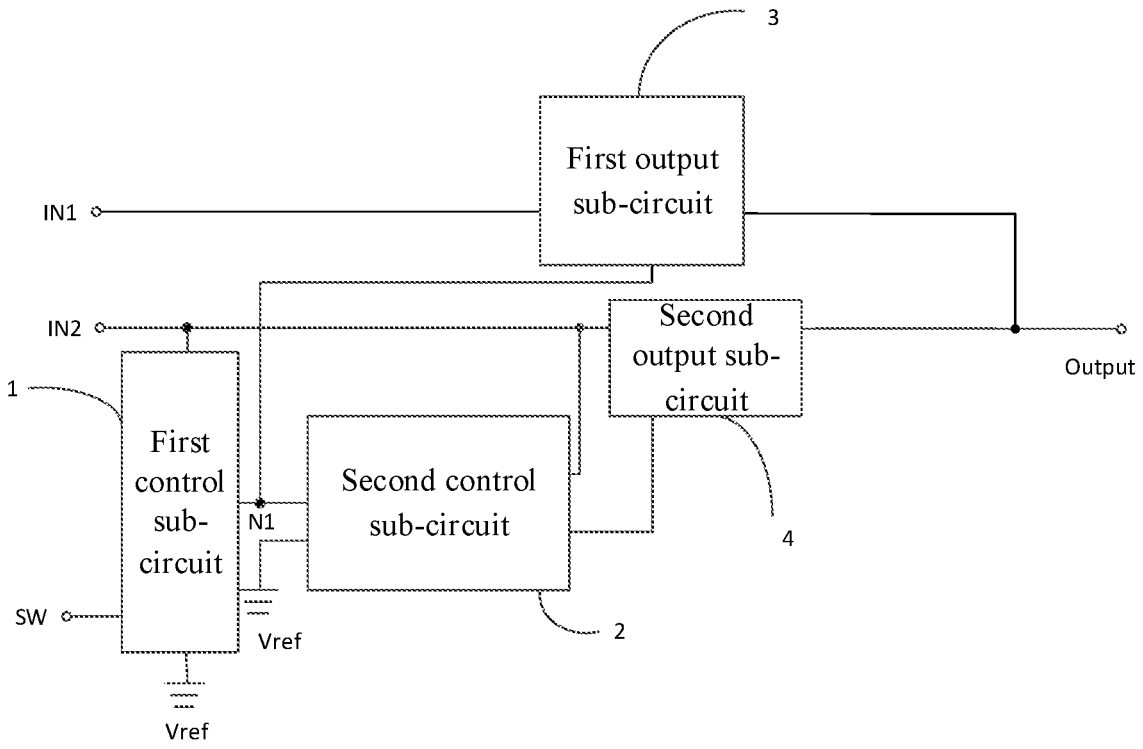
FIG. 1 is a schematic structural diagram of a selection and output circuit according to an embodiment of the present disclosure.

An embodiment of the present disclosure provides a selection and output circuit according to an embodiment of the present disclosure as illustrated in FIG. 1, which includes: a first control sub-circuit 1, a second control sub-circuit 2, a first output sub-circuit 3, a second output sub-circuit 4, a first input terminal IN1, a second input terminal IN2, a reference signal terminal Vref, a control terminal SW, and an output terminal Output.

The first control sub-circuit 1 is configured to provide a first node N1 with a first control signal or a second control signal under the control of the control terminal SW.

The second control sub-circuit 2 is configured to provide the second output sub-circuit 4 with a signal of the second input terminal IN2 when the signal of the first node N1 is the first control signal, and to provide the second output sub-circuit 4 with a signal of the reference signal terminal Vref when the signal of the first node N1 is the second control signal.

The first output sub-circuit 3 is configured to provide the output terminal Output with a signal of the first input terminal IN1 when the signal of the first node N1 is the first control signal.

The second output sub-circuit 4 is configured to provide the output terminal Output with the signal of the second input terminal IN2 when the second control sub-circuit 2 provides the second output sub-circuit 4 with the signal of the reference signal terminal Vref.

The selection and output circuit above according to the embodiment of the present disclosure includes: the first control sub-circuit, the second control sub-circuit, the first output sub-circuit, and the second output sub-circuit, where the first control sub-circuit is configured to provide the first node with the first control signal or the second control signal under the control of the control terminal; the second control sub-circuit is configured to provide the second output sub-circuit with the signal of the second input terminal when the signal of the first node is the first control signal, and to provide the second output sub-circuit with the signal of the reference signal terminal when the signal of the first node is the second control signal; the first output sub-circuit is configured to provide the output terminal with the signal of the first input terminal when the signal of the first node is the first control signal; and the second output sub-circuit is configured to provide the output terminal with the signal of the second input terminal when the second control sub-circuit provides the second output sub-circuit with the signal of the reference signal terminal. The first control sub-circuit, the second control sub-circuit, the first output sub-circuit, and the second output sub-circuit are arranged so that the first output sub-circuit and the second output sub-circuit are controlled by the first control sub-circuit and the second control sub-circuit to operate in such a way that only one of the sub-circuits outputs a signal, and the other sub-circuit outputs no signal, thus switching between different output voltage in different application scenarios; and since the circuit has a simple structure and a small volume, the reliability of the selection and output circuit may be improved, a space occupied for the selection and output circuit may be reduced, and a production cost may be lowered.

An operating principle of the selection and output circuit above according to the embodiment of the present disclosure will be introduced below in details in connection with an optional structure of the selection and output circuit.

Figure 2:
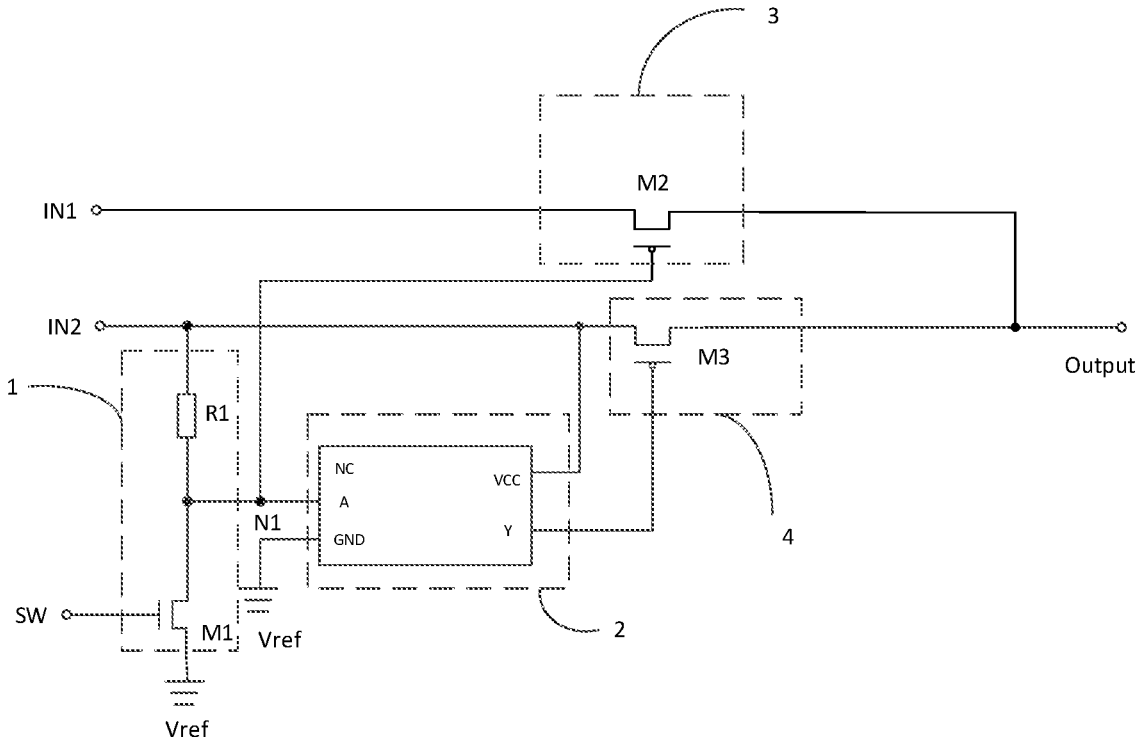
FIG. 2 is a schematic structural diagram of details of the selection and output circuit according to the embodiment of the present disclosure.

Optionally in the selection and output circuit above according to the embodiment of the present disclosure, as illustrated in FIG. 2, the first control sub-circuit 1 includes a first switch transistor M1 and a first resistor R1.

The first switch transistor M1 has a gate connected with the control terminal SW, a first electrode connected with the reference signal terminal Vref, and a second electrode connected with the first node N1.

The first resistor R1 has one terminal connected with the first node N1, and the other terminal connected with the second input terminal IN2.

In some implementations, as illustrated in FIG. 2, the first switch transistor M1 may be an N-type transistor, and at this time, when the potential of the control terminal SW is a high level, the first switch transistor M1 is switched on, and when the potential of the control terminal SW is a low level, the first switch transistor M1 is switched off; or the first switch transistor M1 can alternatively be a P-type transistor (not illustrated), and at this time, when the potential of the control terminal SW is a low level, the first switch transistor M1 is switched on, and when the potential of the control terminal SW is a high level, the first switch transistor M1 is switched off, although the embodiment of the present disclosure will not be limited thereto.

Optionally in the selection and output circuit above according to the embodiment of the present disclosure, when the first switch transistor is switched on under the control of the control terminal, the signal transmitted at the reference signal terminal is transmitted to the first node through the first switch transistor which is switched on, that is, the first node is provided with the first control signal to thereby control the first output sub-circuit; and when the first switch transistor is switched off under the control of the control terminal, the signal of the second input terminal is passed through the first resistor to thereby provide the first node with the second control signal.

An optional structure of the first control sub-circuit in the selection and output circuit has been described above only by way of an example, and in some implementations, the optional structure of the first control sub-circuit will not be limited to the structure above according to the embodiment of the present disclosure, but can alternatively be another structure known to those skilled in the art, although the embodiment of the present disclosure will not be limited thereto.

Optionally in the selection and output circuit above according to the embodiment of the present disclosure, as illustrated in FIG. 2, the second control sub-circuit 2 includes a NOT gate.

The NOT gate has an input terminal A connected with the first node N1, a first power supply terminal GND connected with the reference signal terminal Vref, a second power supply terminal VCC connected with the second input terminal IN2, and an output terminal Y connected with the second output terminal 4.

In an optional implementation, the NOT gate according to the embodiment of the present disclosure has five terminals which are the input terminal A, the first power supply terminal GND, the second power supply terminal VCC, the output terminal Y, and a no-input terminal NC, where the input terminal A is connected with the first node N1.

An optional structure of the second control sub-circuit in the selection and output circuit has been described above only by way of an example, and in some implementations, the optional structure of the second control sub-circuit will not be limited to the structure above according to the embodiment of the present disclosure, but can alternatively be another structure known to those skilled in the art, although the embodiment of the present disclosure will not be limited thereto.

In some implementations—as illustrated in FIG. 2, the first output terminal 3 includes a second switch transistor M2, where the second switch transistor M2 has a gate connected with the first node N1, a first electrode connected with the first input terminal IN1, and a second electrode connected with the output terminal Output.

In some implementations, as illustrated in FIG. 2, when the voltage of the first node N1 is a low level, the second switch transistor M2 is switched on, and the signal of the first input terminal IN1 is output to the output terminal Output through the second switch transistor M2 which is switched on.

It shall be noted that the second switch transistor is a P-type transistor as described in the embodiment above by way of an example, but the second switch transistor may be an N-type transistor, and designed in the same principle without departing from the scope of the present disclosure.

An optional structure of the first output sub-circuit in the selection and output circuit has been described above only by way of an example, and in some implementations, the optional structure of the first output sub-circuit will not be limited to the structure above according to the embodiment of the present disclosure, but can alternatively be another structure known to those skilled in the art, although the embodiment of the present disclosure will not be limited thereto.

Optionally in the selection and output circuit above according to the embodiment of the present disclosure, as illustrated in FIG. 2, the second output sub-circuit 4 includes a third switch transistor M3.

The third switch transistor M3 has a gate connected with the second control sub-circuit 2, a first electrode connected with the second input terminal IN2, and a second electrode connected with the output terminal Output.

In some implementations, as illustrated in FIG. 2, when the signal output by the second control sub-circuit 2 is a low-level signal, the third switch transistor M3 is switched on, and the signal of the second input terminal IN2 is transmitted to the output terminal Output through the third switch transistor M3 which is switched on.

It shall be noted that the third switch transistor is a P-type transistor as described in the embodiment above by way of an example, but the third switch transistor may be an N-type transistor, and designed in the same principle without departing from the scope of the present disclosure.

An optional structure of the second output sub-circuit in the selection and output circuit has been described above only by way of an example, and in some implementations, the optional structure of the second output sub-circuit will not be limited to the structure above according to the embodiment of the present disclosure, but can alternatively be another structure known to those skilled in the art, although the embodiment of the present disclosure will not be limited thereto.

It shall be noted that the switch transistors as referred to in the embodiment above of the present disclosure may be Thin Film Transistors (TFTs), or may be Metal Oxide Semiconductor (MOS) field-effect transistors, although the embodiment of the present disclosure will not be limited thereto. In some implementations, sources and drains of these transistors may be interchanged with each other instead of being distinguished from each other. The optional embodiments have been described by way of an example in which all the driver transistors and switch transistors are thin film transistors.

Figure 3:
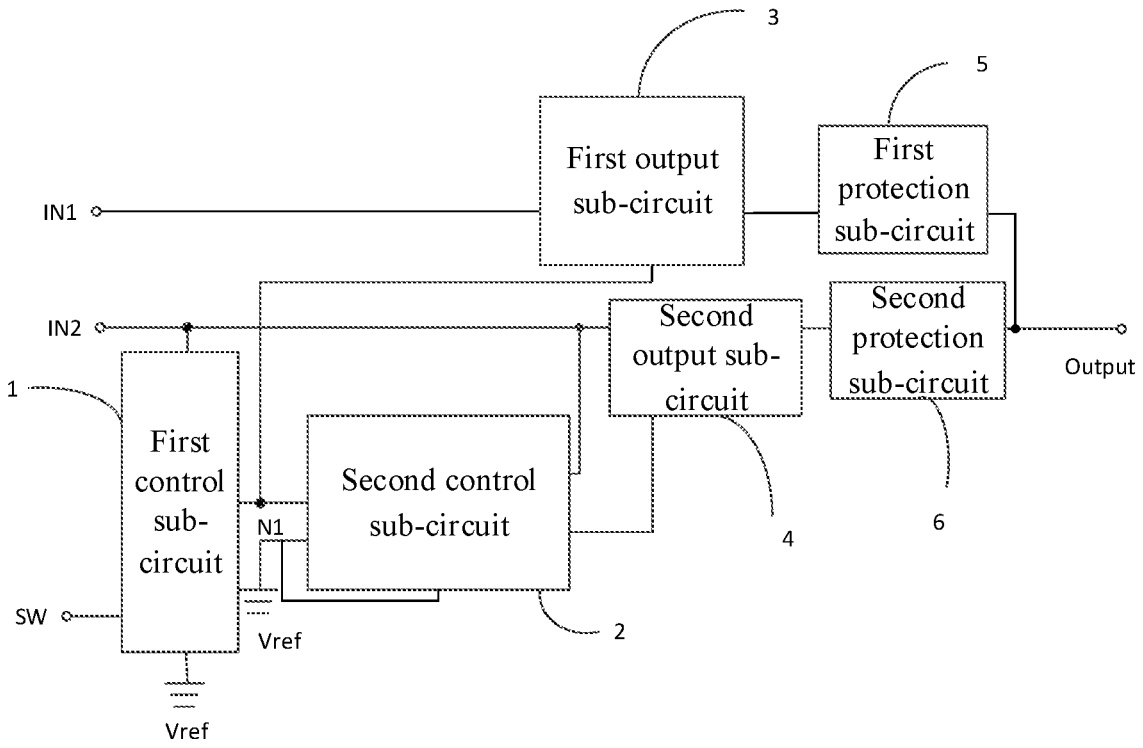
FIG. 3 is a schematic structural diagram of a selection and output circuit according to an embodiment of the present disclosure.

In some implementations, in order to prevent a signal being output by the second output sub-circuit 4 from being transferred back to the first output sub-circuit 3, in the selection and output circuit above according to the embodiment of the present disclosure, as illustrated in FIG. 3, the selection and output circuit further includes a first protection sub-circuit 5.

The first protection sub-circuit 5 is only configured to provide the output terminal Output with the signal output by the first output sub-circuit 3.

Figure 4:
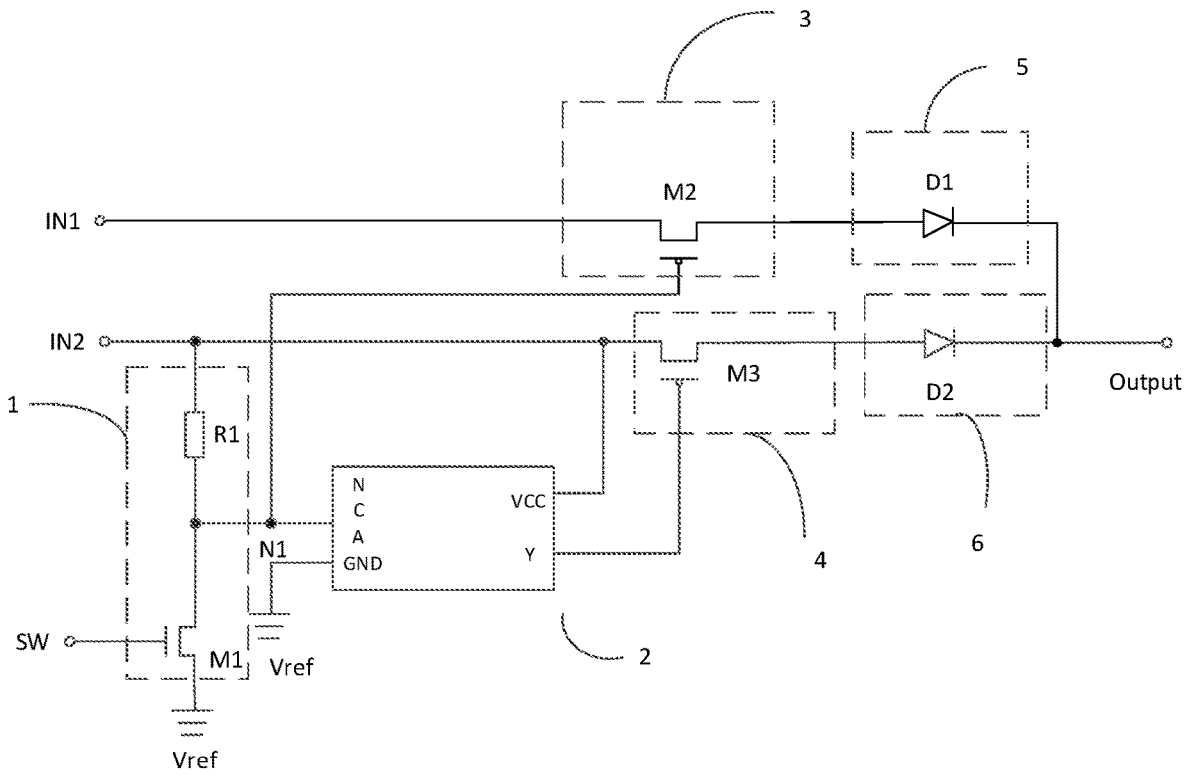
FIG. 4 is a schematic structural diagram of details of the selection and output circuit according to the embodiment of the present disclosure.

Optionally in the selection and output circuit above according to the embodiment of the present disclosure, as illustrated in FIG. 4, the first protection sub-circuit 5 includes a first diode D1, where: the first diode D1 has an input terminal connected with the first output sub-circuit 3, and an output terminal connected with the output terminal Output.

Due to unidirectional conductivity of the second diode, only the signal output by the first output sub-circuit may be transmitted to the output terminal through the first diode, and the first output sub-circuit cannot be provided with the signal of the output terminal through the first diode, so that the circuit can output stably.

An optional structure of the first protection sub-circuit in the selection and output circuit has been described above only by way of an example, and in some implementations, the optional structure of the first protection sub-circuit will not be limited to the structure above according to the embodiment of the present disclosure, but can alternatively be another structure known to those skilled in the art, although the embodiment of the present disclosure will not be limited thereto.

In some implementations, in order to prevent a signal being output by the first output sub-circuit 3 from being transferred back to the second output sub-circuit 4, in the selection and output circuit above according to the embodiment of the present disclosure, as illustrated in FIG. 3, the selection and output circuit further includes a second protection sub-circuit 6, where: the second protection sub-circuit 6 is only configured to provide the output terminal Output with the signal output by the second output sub-circuit 4.

Optionally in the selection and output circuit above according to the embodiment of the present disclosure, as illustrated in FIG. 4, the second protection sub-circuit 6 includes a second diode D2.

The second diode D2 has an input terminal connected with the second output sub-circuit 4, and an output terminal connected with the output terminal Output.

Due to unidirectional conductivity of the second diode, only the signal output by the second output sub-circuit may be transmitted to the output terminal through the second diode, and the second output sub-circuit cannot be provided with the signal of the output terminal through the second diode, so that the circuit can output stably.

An optional structure of the second protection sub-circuit in the selection and output circuit has been described above only by way of an example, and in some implementations, the optional structure of the second protection sub-circuit will not be limited to the structure above according to the embodiment of the present disclosure, but can alternatively be another structure known to those skilled in the art, although the embodiment of the present disclosure will not be limited thereto.

An operating process of the selection and output circuit according to the embodiment of the present disclosure applied to a liquid crystal display panel will be described below taking the selection and output circuit as illustrated in FIG. 4, where the voltage of the first input terminal IN1 is 3.3V, the voltage of the second input terminal IN2 is 5V, the first switch transistor M1 is an N-type transistor, the second switch transistor M3 is a P-type transistor, and the third switch transistor M3 is a P-type transistor.

When the signal of the control terminal SW is at a high level, the first switch transistor M1 is switched on, and the first node N1 is provided with the signal of the reference signal terminal Vref through the first switch transistor M1 which is switched on, where the potential of the reference signal terminal Vref is a low potential or grounded, and at this time, the gate of the second switch transistor M2 is 0V, so the VGS of the second switch transistor M2 is −3.3V, where the VGS of the second switch transistor M2 is below −1.3V, so the second switch transistor M2 is switched on; and at this time, since the first node N1 is at 0V, the voltage output by the NOT gate is 5V, that is, the voltage at the gate of the third switch transistor M3 is 5V, so the VGS of the third switch transistor M3 is 0V, where the VGS of the third switch transistor M3 is below −1.3V, so the third switch transistor M3 is switched off. In summary, when the signal of the control terminal SW is a high level, the signal output at the output terminal Output is the signal of the first input terminal IN1, that is, the voltage output at the output terminal Output is 3.3V.

When the signal of the control terminal SW is at a low level, the first switch transistor M1 is switched off, and the voltage of the first node N1 is the voltage of the signal of the second input terminal IN2 passed through the first resistor R1, that is, at this time, the potential of the first node N1 is a high level of approximately 5V, so the VGS of the second switch transistor M2 is 1.7V, and the second switch transistor M2 is switched off; and at this time, the voltage of the first node N1 is 5V, and the voltage output by the NOT gate is 0V, that is, the voltage at the gate of the third switch transistor M3 is 0V, so the VGS of the third switch transistor M3 is −5V, the third switch transistor M3 is switched on, and the signal of the second input terminal IN2 is transmitted to the output terminal Output through the third switch transistor M3 which is switched on. In summary, when the signal of the control terminal SW is a low level, the signal output at the output terminal Output is the signal of the second input terminal IN2, that is, the voltage output at the output terminal Output is 5V.

It shall be noted that the lowest voltage of the first input terminal and the first input terminal depends upon the cutoff voltage VGS of the second switch transistor and the third switch transistor, and the highest voltage thereof depends upon the characteristic of the input terminal of the NOT gate, where when the selection and output circuit is applied to a liquid crystal display, the cutoff voltage VGS of the second switch transistor and the third switch transistor is 1V, and the highest voltage of the input terminal of the NOT gate is 5V, so the voltage of the first output terminal ranges from 1V to 5V, and the voltage of the second input terminal also ranges from 1V to 5V, where particular values thereof are set as needed.

It shall be noted that the application scope above is only one embodiment of the selection and output circuit in a particular application, and applications of the selection and output circuit in other scenarios will depend upon particular situations, and particular characteristics of devices thereof, although the embodiment of the present disclosure will not be limited thereto.

Based upon the same inventive idea, an embodiment of the present disclosure further provides a display device including the selection and output circuit according to any one of the embodiments above. The display device may be a monitor, a mobile phone, a TV set, a notebook computer, an all-in-one machine, etc., and all the other components indispensable to the display device shall readily occur to those ordinarily skilled in the art, so a repeated description thereof will be omitted here, and the embodiment of the present disclosure will not be limited thereto.

In the selection and output circuit, and the display device above according to the embodiments of the present disclosure, the selection and output circuit includes: the first control sub-circuit, the second control sub-circuit, the first output sub-circuit, and the second output sub-circuit, where the first control sub-circuit is configured to provide the first node with the first control signal or the second control signal under the control of the control terminal; the second control sub-circuit is configured to provide the second output sub-circuit with the signal of the second input terminal when the signal of the first node is the first control signal, and to provide the second output sub-circuit with the signal of the reference signal terminal when the signal of the first node is the second control signal; the first output sub-circuit is configured to provide the output terminal with the signal of the first input terminal when the signal of the first node is the first control signal; and the second output sub-circuit is configured to provide the output terminal with the signal of the second input terminal when the second control sub-circuit provides the second output sub-circuit with the signal of the reference signal terminal. The first control sub-circuit, the second control sub-circuit, the first output sub-circuit, and the second output sub-circuit are arranged so that the first output sub-circuit and the second output sub-circuit are controlled by the first control sub-circuit and the second control sub-circuit to operate in such a way that only one of the sub-circuits outputs a signal, and the other sub-circuit outputs no signal, thus switching between different output voltage in different application scenarios; and since the circuit has a simple structure and a small volume, the reliability of the selection and output circuit may be greatly improved, a space occupied for the selection and output circuit may be reduced, and a production cost may be lowered.

Evidently those skilled in the art can make various modifications and variations to the present disclosure without departing from the spirit and scope of the present disclosure. Thus the present disclosure is also intended to encompass these modifications and variations thereto so long as the modifications and variations come into the scope of the claims appended to the present disclosure and their equivalents.

The invention claimed is:

1. A selection and output circuit, comprising: a first control sub-circuit, a second control sub-circuit, a first output sub-circuit, a second output sub-circuit, a first input terminal, a second input terminal, a reference signal terminal, a control terminal, and an output terminal, wherein:

the first control sub-circuit comprises a first switch transistor and a first resistor, wherein the first switch has a gate connected with the control terminal, a first electrode connected with the reference signal terminal, and a second electrode connected with the first node; and the first resistor has one terminal connected with a first node, and the other terminal connected with the second input terminal, the first control sub-circuit is configured to provide the first node with a first control signal or a second control signal under the control of the control terminal;

wherein the first control signal is from the reference signal terminal, the second control signal is from the second input terminal; the first control signal and the second control signal are inverted signals;

the second control sub-circuit comprising a NOT gate, wherein the NOT gate has an input terminal connected with the first node, a first power supply terminal connected with the reference signal terminal, a second power supply terminal connected with the second input terminal, and an output terminal connected with the second output terminal, the second control sub-circuit is configured to provide the second output sub-circuit with a signal of the second input terminal when the signal of the first node is the first control signal via the NOT gate, and to provide the second output sub-circuit with a signal of the reference signal terminal when the signal of the first node is the second control signal via the NOT gate;

the first output sub-circuit comprising a second switch transistor, wherein the second switch transistor has a gate connected with the first node, a first electrode connected with the first input terminal, and a second electrode connected with the output terminal, the first output sub-circuit is configured to provide the output terminal with a signal of the first input terminal when the signal of the first node is the first control signal; and the second output sub-circuit comprising a third switch transistor, wherein the third switch transistor has a gate connected with the output terminal of the NOT gate of the second control sub-circuit, a first electrode connected with the second input terminal, and a second electrode connected with the output terminal, the second output sub-circuit is configured to provide the output terminal with the signal of the second input terminal when the second control sub-circuit provides the second output sub-circuit with the signal of the reference signal terminal, the selection and output circuit, further comprising a first protection sub-circuit and a second protection sub-circuit, wherein:

the first protection sub-circuit comprises a first diode, wherein the first diode has an input terminal connected with the first output sub-circuit, and an output terminal connected with the output terminal, the first protection sub-circuit is configured to provide the output terminal with the signal output by the first output sub-circuit;

the second protection sub-circuit comprising a second diode, wherein the second diode has an input terminal connected with the second output sub-circuit, and an output terminal connected with the output terminal, the second protection sub-circuit is configured to provide the output terminal with the signal output by the second output sub-circuit.

2. A display device, comprising the selection and output circuit according to claim 1.

* * * * *